US006562437B2

(12) United States Patent
Bunkley

(10) Patent No.: US 6,562,437 B2
(45) Date of Patent: May 13, 2003

(54) FABRIC TOWEL HOLDER

(76) Inventor: Anita Richmond Bunkley, 3554 Ashfield Dr., Houston, TX (US) 77082-5306

( * ) Notice: Subject to any disclaimer, the term of this patent is extended or adjusted under 35 U.S.C. 154(b) by 0 days.

(21) Appl. No.: 09/822,900

(22) Filed: Mar. 30, 2001

(65) Prior Publication Data

US 2002/0142113 A1 Oct. 3, 2002

(51) Int. Cl.[7] ..... B32B 3/04

(52) U.S. Cl. ..... 428/126; 428/100; 428/99; 428/78

(58) Field of Search ..... 428/100, 99, 126, 428/78; 273/32

(56) References Cited

U.S. PATENT DOCUMENTS

| | | | | |
|---|---|---|---|---|
| 2,669,737 A | | 2/1954 | Evans | 15/122 |
| D221,200 S | * | 7/1971 | Clementi | D6/9 |
| 4,403,366 A | | 9/1983 | Lucke | 15/209 R |
| D317,995 S | * | 7/1991 | Crowley-McGregor | D6/608 |
| 5,286,019 A | * | 2/1994 | Watabe | 273/32 |
| 5,326,610 A | | 7/1994 | Moss | 428/78 |
| 5,761,761 A | | 6/1998 | An | 15/209 |
| 5,770,284 A | | 6/1998 | Logemann | 428/36.1 |
| 5,797,142 A | | 8/1998 | Debronsky, Jr. et al. | 2/69 |

OTHER PUBLICATIONS

Fisher et al.; Dec. 18, 1997, Method of Manufacturing Clear Brine Fluids from Impure Zinc Feedstock, Ser. No. 08/993, 914.

* cited by examiner

*Primary Examiner*—Harold Pyon
*Assistant Examiner*—Jane Rhee
(74) *Attorney, Agent, or Firm*—D'Ambrosio & Associates, P.L.L.C.; Jo Katherine D'Ambrosio

(57) ABSTRACT

A fabric towel holder for hand towels comprises a fabric sheet that is twice-folded along its longitudinal axis to form a first panel, a third panel and a second panel positioned between the first panel and the third panel. The first panel comprises a first longitudinal end and the third panel comprises a second longitudinal end securely attached to the first longitudinal end. The longitudinally folded fabric sheet is also folded along its transverse axis to form a first segment having a first front side and a first back side, and a second segment having a second front side and a second back side. A fabric member is attached to the first front side so that the fabric member and first front side of the second panel define a pocket adapted for holding hand towels. A hook fastener is attached to the first back side and a loop fastener is attached to the second back side so that the loop fastener adheres to the hook fastener when the fabric sheet is folded along its transverse axis.

9 Claims, 3 Drawing Sheets

FABRIC TOWEL HOLDER

FIELD OF THE INVENTION

The present invention relates to fabric towel holders, more particularly to a fabric towel holder comprising a pocket for holding hand towels.

BACKGROUND OF THE INVENTION

Homeowners often expend considerable efforts and financial means on the interior design of their homes, guest bedrooms and bathrooms included. As a result, guest bathrooms are often exquisitely decorated with beautiful and expensive accessories, among them hand towels and washcloths elaborately selected and presented in a way that enhances the overall bathroom design.

Often times, guests hesitate to use the homeowners' hand towels because they do not want to inadvertently dirty the towels or disturb the bathroom's design. In addition, many people are cautious and wish to protect themselves from contagious diseases, and are highly reluctant to use someone else's cloth towels. Disposable paper towels are preferred. At present, there is a variety of paper towels with attractive designs whose qualities make them appealing to homeowners for use by their guests. Unfortunately, attractive holders for these disposable paper towels are difficult to find.

Evans, U.S. Pat. No. 2,669,737, and Moss, U.S. Pat. No. 5,326,610, disclose washcloths with a built-in pocket that can hold a bar of soap, ice or other cold material. Longemann, U.S. Pat. No. 5,770,284, discloses a sports towel with an integrated storage pocket that has a closure device to secure items within the pocket.

Lucke, U.S. Pat. No. 4,403,366, discloses a removable towel means comprising a U-shaped clip support member mountable on the pants or accessories worn by the user, and a detachable length of toweling. The toweling can be attached to the support member by loop and hook gripping means, and may have an integral pocket with or without loop and hook means. Debronsky, Jr. et al., U.S. Pat. No. 5,797,142, discloses a golf towel assembly comprising an upper portion for fastening to a golfer's front waist area by various means, one of which may be Velcro® fasteners, and a lower, terry cloth portion for wiping debris from a golf club.

An, U.S. Pat. No. 5,761,761, discloses a rectangular tri-sectioned golf towel with an inner and outer sides made from different materials, and an upper end permanently stitched. A Velcro® looping patch can be secured adjacent to the permanently stitched end, and a second hooking patch can then be attached near the opposite, not-bound end of the same side and section of the towel.

Watabe, U.S. Pat. No. 5,286,019, discloses a combination of a golf club handle support and a wiper, the handle support comprising a shaft with a semi-circular bracket attached to one of its ends, and the wiper comprising a fabric material component and a toweling material component. The wiper can be attached to the support by Velcro® pads fastened to the towel in such a way that one end of the towel can be folded over the bracket and held to the remainder by the Velcro® fastening tabs.

None of the above references, taken either singlely or in combination, describes or suggests the instant invention as claimed. What is needed and desirable is a fabric towel holder to hold and display disposable hand towels while coordinating with the overall bathroom design.

SUMMARY OF THE INVENTION

The present invention relates to a fabric towel holder constructed to hold hand towels for use in guest bathrooms.

In one preferred embodiment, the fabric towel holder comprises a fabric sheet such as a standard sized hand towel with a fabric member, a washcloth for example, folded and sewn on to the front of the standard sized hand towel so that the wash cloth as attached to the fabric sheet, forms a pocket. Preferably, the hand towel is folded longitudinally with the washcloth pocket positioned on its front. The back of the hand towel preferably comprises fastening means such as Velcro® hook and loop fasteners. When the hand towel is folded transversely about a towel ring or hanging loop, the hook and loop fasteners fasten the back of the hand towel so that it does not slip off the towel ring because of the weight of objects in the pocket, the disposable paper hand towels for example. The pocket may also be used to hold other small bath or grooming objects.

In one preferred embodiment, the fabric towel holder for holding hand towels comprises a fabric sheet, a standard sized hand towel for example, that has a front and a back. The back comprises an upper section and a lower section. The fabric sheet has a transverse axis and a longitudinal axis. The fabric sheet can be folded along the transverse axis so that the upper section of the back is adjacent to the lower section of the back. When a hook fastener is attached to the upper section of the back side and a loop fastener is attached to the lower section of the back side, the loop fastener adheres to the hook fastener so that the upper section is adjacent to and fastened to the lower section of the back.

A fabric member can be fixedly attached to the fabric sheet so that the fabric member, when attached to the fabric sheet, defines a pocket. The pocket can be adapted to hold smaller hand towels, decorative paper hand towels or small bath items. Preferably, the fabric sheet can be folded longitudinally either in half or thirds and the longitudinal ends seamed. The fabric member or washcloth can be folded and positioned on the bottom front of folded fabric sheet to form the pocket. Disposable or smaller hand towels such as attractive paper towels or napkins can be placed within the pocket. When folded transversely over a towel rod or ring, the fabric towel holder of this invention can be coordinated to the overall decorative design of the guest bathroom.

DETAILED DESCRIPTION OF THE INVENTION

The present invention is a fabric towel holder for hand towels. The fabric towel holder of this invention holds and displays disposable hand towels while coordinating with the overall design of a bathroom; particularly guest bathrooms that are often decorated with beautiful and expensive accessories, among them attractive hand towels and washcloths that enhance the overall bathroom decor.

Preferably, the fabric towel holder comprises a fabric sheet such as a standard sized hand towel with a fabric member, a washcloth for example, folded and sewn on to the front of the standard sized hand towel so that the wash cloth forms a pocket. In one aspect, the hand towel can be folded longitudinally with the pocket positioned on its front. The back of the hand towel preferably comprises fastening means such as Velcro® hook and loop fasteners. When the hand towel is folded transversely about a towel ring or hanging loop, the hook and loop fasteners hold the back of the hand towel together to prevent it from slipping off the towel ring because of the weight of objects in the pocket. The pocket may be used to hold other small bath, disposable paper hand towels or grooming objects.

Figure 1:
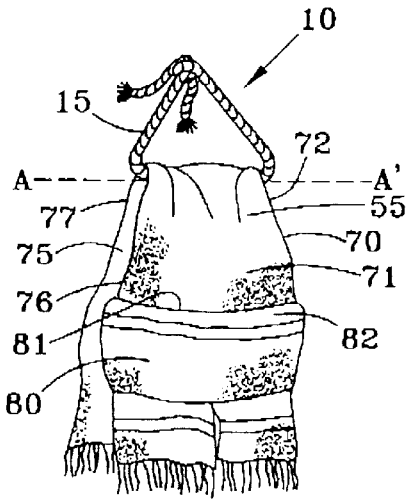
FIG. 1 illustrates one embodiment of this invention as folded over a hanger.

FIG. 1 refers to one embodiment of the fabric towel holder 10 of this invention. In this embodiment, the fabric towel holder for hand towels 10 comprises a fabric sheet 20 such as a terry cloth hand towel as typically found in retail stores. Any fabric that is flexible and suitable for bathrooms can be used, cotton cloth, flannel, polyesters, even leather for contemporary styles, for example. Ready-made hand towels are available in various sizes, as are ready-made wash cloths. In one embodiment, a ready-made hand towel can be used for the fabric sheet 20 and a ready-made washcloth can be used for the fabric member 80. Alternatively, a suitably sized fabric sheet 20 and fabric member 80 can be used. In one preferred embodiment, the size of the fabric sheet is approximately 28 inches by 16 inches. The fabric member 80 can comprise dimensions of 12 inches by 13 inches. Variations in the size of the fabric sheet 20 and fabric member 80 are within the scope of this invention 10.

Figure 2:
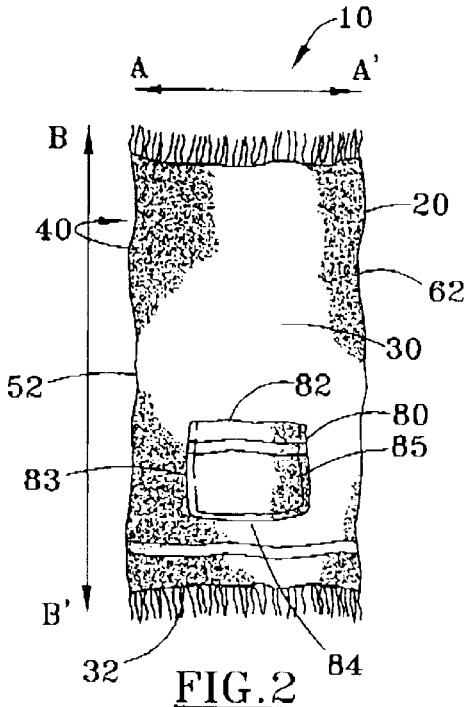
FIG. 2 illustrates another embodiment of this invention.
Figure 2A:
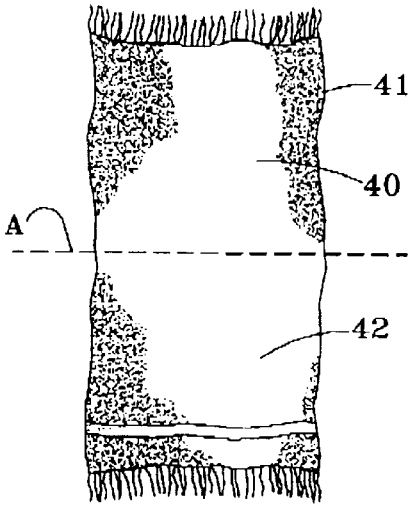
FIG. 2A illustrates the back of FIG. 2.

Referring to FIGS. 1, 2 and 2*a*, the fabric sheet 20 has a front 30 and a back 40. The back of the fabric sheet 40 comprises an upper section 41 and a lower section 42. When the fabric sheet 20 is folded along its transverse axis, the upper section of the back 41 is adjacent to the lower section of the back 42. A fabric member 80, wash cloth, for example, can be attached to the fabric sheet 20 so that the fabric member 80 and fabric sheet 20 define a pocket 81. Preferably, the pocket 81 is adapted to hold hand towels for use in the bathroom. The pocket 81 can also be adapted to hold other bath or toiletry items. Both the fabric sheet 20 and the fabric member 80 can be decorative cloths, either matching or coordinated to each other. The hand towels stored in the pocket 81 are to be used for drying hands and, as such, can be disposable, paper towels for example, that are decorative and coordinate with the fabric towel holder of this invention.

When the fabric sheet 20 is folded along its transverse axis, A–A', it can be placed over a towel ring or a towel bar, not shown. Alternatively, as illustrated in FIG. 1, a decorative hanger 15 can be used to hang the fabric towel holder 10 on a hook. Since the weight of objects within the pocket 81 formed by the fabric member 80 can cause the fabric towel holder 10 to slip off a towel ring or bar, the fabric towel holder further comprises a fastener 90 to hold and position the front 30 of the towel holder 10 in alignment with the back 40. The fastener 90 can comprise a hook fastener 91 attached to the upper section of the back 41 and a loop fastener 92 attached to the lower section of the back 42. The loop fastener 92 can adhere to the hook fastener 91 when the fabric sheet 20 is folded along its transverse axis, A–A' so that the upper section 41 is adjacent and secured to the lower section 42 of the back side 40. Other fasteners can be used to fasten the upper section 41 to the lower section 42 to prevent the fabric towel holder from slipping such as snaps or buttons.

Figure 3:
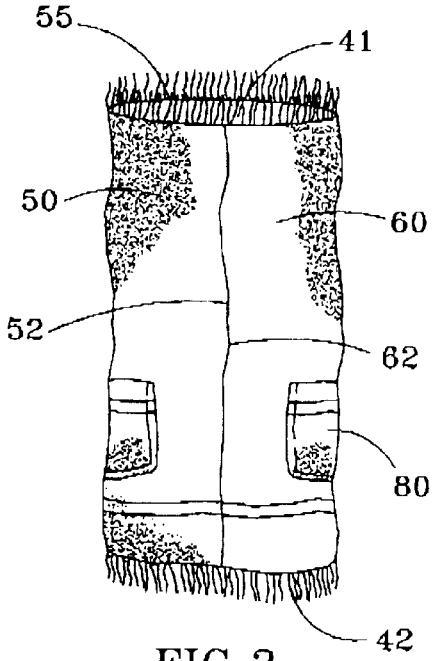
FIG. 3 illustrates an embodiment of the invention with the fabric sheet folded longitudinally.
Figure 4:
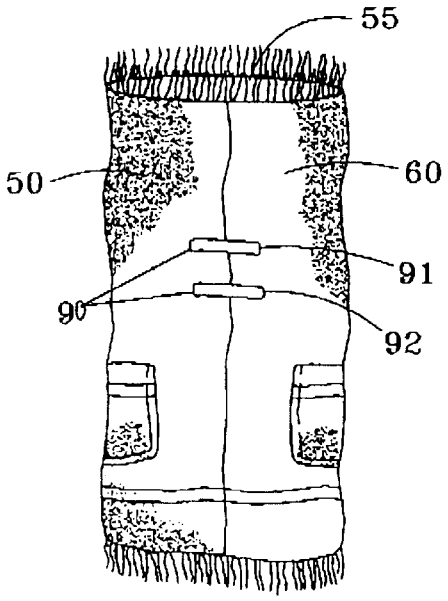
FIG. 4 depicts another embodiment of the invention with the fabric sheet folded longitudinally.

In another preferred embodiment of the fabric towel holder for hand towels, as shown in FIGS. 3 and 4, the fabric sheet 20 can be twice-folded along its longitudinal axis B–B' to form a first panel 50, a second panel 55, and a third panel 60. The second panel 55 is positioned between the first panel 50 and the third panel 60. The first panel 50 and the third panel 60 preferably have equal widths and the second panel 55 can have a width equal to the sum of the widths of the first panel 50 and third panel 60. The first panel 50 can comprise a first longitudinal end 52 and the third panel can comprise a second longitudinal end 62. In this embodiment, the first longitudinal end 52 is securely attached to the second longitudinal end 62. The first and second longitudinal ends, 52, 62 can be attached by sewing them together. Alternatively, the longitudinal ends 52, 62 can be attached by fabric glue or adhesive.

When the longitudinally folded fabric sheet 20 is folded along its transverse axis A–A', as seen in FIG. 1, it forms a first segment 70 and a second segment 75, the first segment 70 having a first front side 71 and a first back side 72, the second segment 75 having a second front side 76 and a second back side 77. A fabric member 80 can be folded parallel to one of its ends. The folded fabric member 80 comprises three unfolded edges 83, 84, 85 and a folded edge 82. The unfolded ends 83, 84, 85 are securely attached to the first segment 70 to define the pocket 81. The folded member is positioned adjacent the first front side 76 so that a folded edge 82 of the fabric member forms a smooth top of the pocket 81. In this way, the fabric sheet 20 and the fabric member 80 define a pocket 81 that is adapted for holding hand towels. This embodiment further comprises a hook fastener 91 and a loop fastener 92, the hook fastener 91 attached to the first back side 72, the loop fastener 92 can be attached to the second back side 77 so that the loop fastener 92 adheres to the hook fastener 91 when the fabric sheet 20 is folded along its transverse axis A–A'. Conversely, the hook fastener 91 can be attached to the second back side 77 and the loop fastener 92 attached to the first back side 72. Other types of fasteners are within the scope of this invention, snaps, sewing the first back side 72 to the second back side 77, or a form of adhesive can be used. In this embodiment, the fabric sheet 20 can be a standard sized readily available hand towel and the fabric member 80 can be a standard sized readily available washcloth. A hanger 15 can be secured between the first back side 72 and the second back side 77 of the fabric sheet 20 to hang the finished fabric towel holder 10 over a hook (not shown).

Figure 5:
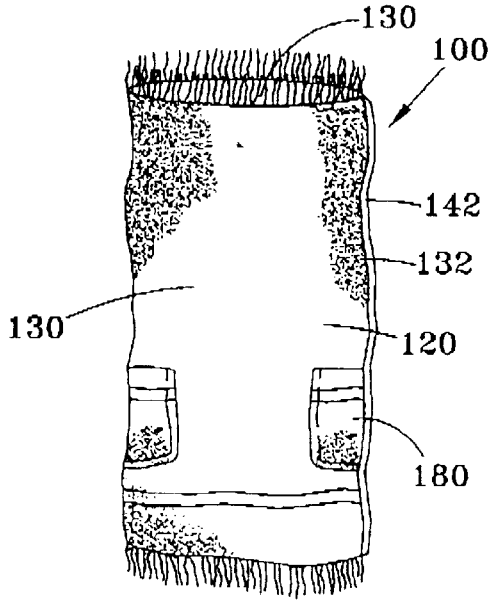
FIG. 5 depicts still another embodiment of the invention having one longitudinal fold.
Figure 6:
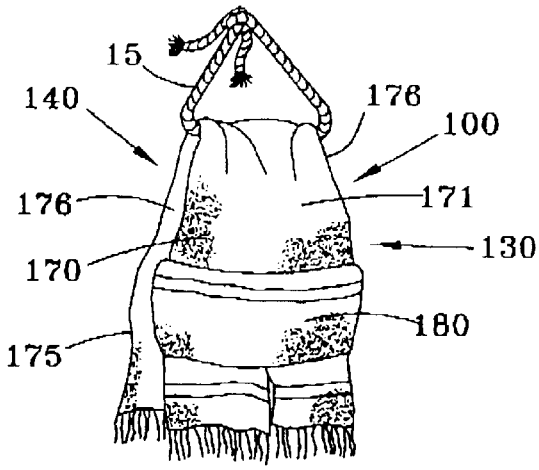
FIG. 6 depicts the embodiment of FIG. 5 as folded over a hanger.

In an alternative embodiment of this invention as illustrated by FIGS. 5 and 6, the fabric towel holder 100 for hand towels comprises a fabric sheet 120 folded once along its longitudinal axis to form a front panel 130, and a back panel 140. The front panel 130 comprises a front longitudinal end 132 and the back panel 140 comprises a back longitudinal end 142. Preferably, the front longitudinal end 132 is securely attached to the back longitudinal end 142. As in previously described embodiments, the ends 132, 142 can be sewn together or joined by adhesive. As illustrated in FIG. 6 the longitudinally folded fabric sheet 120 is then folded along its transverse axis to form a first segment 170 and a second segment 175. The first segment 170 comprises a first front side 171 and a first back side 172, the second segment 175 can comprise a second front side 176 and a second back side 177. A fabric member 180 can be attached to the first front side 171 so that the fabric member 180 and fabric sheet 120 define a pocket 181 that is adapted for holding hand towels. When folded along its transverse axis, the fabric towel holder 100 can be placed over a hanger 15 or towel bar, not shown. Paper or other disposable hand towels can be placed in the pocket 181. A first fastener 191 can be attached to the first back side 172 and a second fastener 192 attached to the second back side 177 so that the first fastener 172 fastens to the second fastener 177 when the fabric sheet 120 is folded along its transverse axis. The fasteners can comprise hook and loop fasteners. When the hook fastener is attached or fastened to the loop fastener, the front panel 130 is secured to the back panel 140 to prevent slippage of the fabric towel holder 100 that is caused by the weight of the towels or other objects placed in the pocket 181.

A method for manufacturing the fabric towel holder of this invention comprises using readily available hand towels and washcloths or fabric sheets cut to a desirable size. The method comprises folding a washcloth 80 parallel to one of its ends 82, 83, 84, 85 so that it comprises a folded end 82 and three unfolded ends 83, 84, 85. The washcloth 80 is placed adjacent a hand towel 20 having front side 30, a back side 40 and a top end 31 and a bottom end 32. The washcloth 80 can be positioned on the front side 30 adjacent the bottom end 32 of the hand towel with the folded end 82 of the washcloth directed towards the top end of the hand towel 31. The washcloth can be securely attached to the front side 30 of the hand towel so that the washcloth 80 and hand towel 20 define a pocket 81. The hand towel is then folded along its longitudinal axis B–B' so that the two longitudinal ends 52, 62 of the hand towel are adjacent to each other. Finally the two longitudinal ends 52, 62 of the hand towel are securely attached to each other 52, 62 and a hook fastener 91 and a loop fastener 92 are secured to the back side of the folded hand towel so that an upper back side of the hand towel is affixed to a lower back side of the hand towel when the hand towel is folded along its transverse axis.

Figure 7:
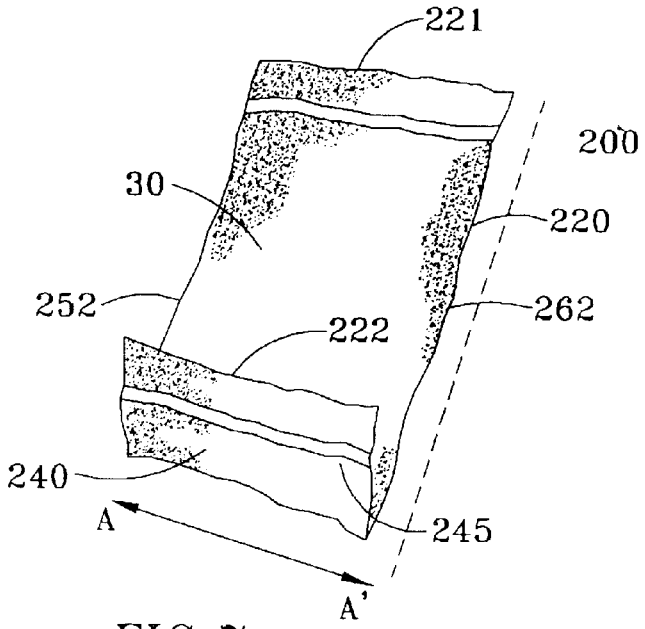
FIG. 7 illustrates a further embodiment of this invention.
Figure 8:
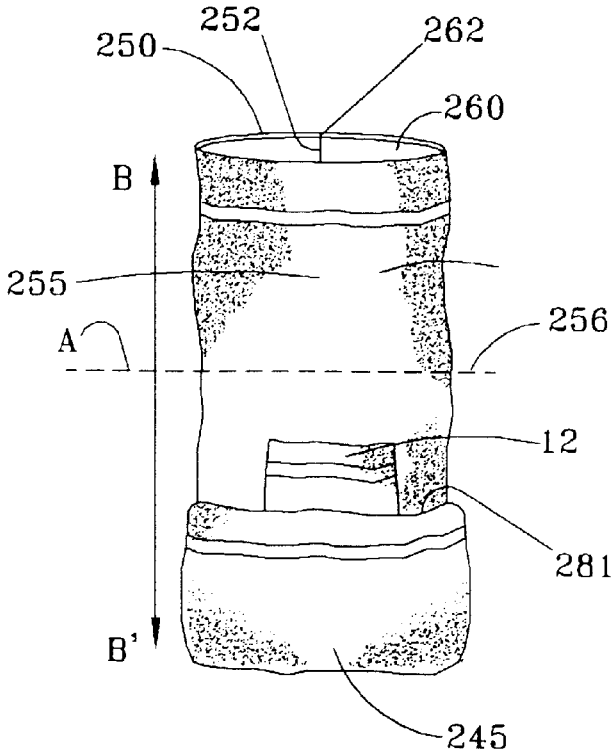
FIG. 8 depicts the embodiment of FIG. 7 longitudinally folded.

FIGS. 7 and 8 depict still another embodiment of the fabric towel holder 200. In this embodiment, the fabric towel holder 200 comprises a fabric sheet 220 having a front 230 and a back 240. The fabric sheet 220 has a top 221 and a bottom 222. By folding the bottom 221 of the fabric sheet 220 transversely A–A', the fabric sheet 220 forms a pocket panel 245. The front of the fabric sheet 230 and the pocket panel 245 define a pocket 281 for holding disposable hand towels 12 or other bath items.

The fabric sheet 220 can be twice-folded along its longitudinal axis B–B' to form a first panel 250, a second panel 255, and a third panel 260. The second panel 255 is positioned between the first panel 250 and the third panel 20. The first panel 250 and the third panel 260 preferably have equal widths and the second panel 255 can have a width equal to the sum of the widths of the first panel 250 and third panel 260. The first panel 250 can comprise a first longitudinal end 252 and the third panel 260 ban comprise a second longitudinal end 262. In this embodiment, the first longitudinal end 252 is securely attached to the second longitudinal end 262. The first and second longitudinal ends, 52, 62 can be attached by sewing them together. Alternatively, the longitudinal ends 52, 62 can be attached by fabric glue or adhesive. The longitudinally folded fabric sheet 220 comprises a midpoint 256.

After the pocket 281 is defined and the fabric sheet 220 folded longitudinally, the fabric towel sheet 220 can be folded transversely approximately at its midpoint 256 over a hanger, towel ring or towel bar and decorative paper towels or bath utensils placed within the pocket 281. Hoop and loop fasteners can be used as described in other embodiments to prevent slippage when objects 12 are placed within the pocket 281.

The foregoing description is illustrative and explanatory of preferred embodiments of the invention, and variations in the size, shape, materials and other details will become apparent to those skilled in the art. It is intended that all such variations and modifications which fall within the scope or spirit for the appended claims be embraced thereby.

What is claimed is:

1. A fabric towel holder for hand towels comprising:

a fabric sheet, the fabric sheet twice-folded along its longitudinal axis to form a first panel, a second panel, and a third panel, the second panel positioned between the first panel and the third panel, the first panel and the third panel having equal widths, the second panel having a width equal to the sum of the widths of the first panel and third panels, the first panel comprising a first longitudinal end, the third panel comprising a second longitudinal end, the first longitudinal end securely attached to the second longitudinal end, the longitudinally folded fabric sheet folded along its transverse axis to form a first segment and a second segment, the first segment having a first front side and a first back side, the second segment having a second front side and a second back side;

a fabric member attached to the first front side, the fabric member and first front side of the second panel defining a pocket, the pocket adapted for holding hand towels; and a hook fastener and a loop fastener, the hook fastener attached to the first back side, the loop fastener attached to the second back side, the loop fastener adhering to the hook fastener when the fabric sheet is folded along its transverse axis.

2. The fabric towel holder of claim 1, wherein the fabric sheet comprises a hand towel.

3. The fabric towel holder of claim 1, wherein the fabric member comprises a washcloth, the washcloth folded parallel to one of its ends, the folded washcloth positioned adjacent the first front side, the folded washcloth comprising three unfolded ends, the unfolded ends securely attached to the first segment to define the pocket.

4. The fabric towel holder of claim 1, further comprising a hanger, the hanger secured between the first back side and the second back side of the fabric sheet.

5. A fabric towel holder for hand towels comprising:

a fabric sheet, the fabric sheet folded along its longitudinal axis to form a front panel and a back panel;

the front panel comprising a front longitudinal end, the back panel comprising a back longitudinal end, the front longitudinal end securely attached to the back longitudinal end;

the fabric sheet folded along its transverse axis to form a first segment and a second segment, the first segment having a first front side and a first back side, the second segment having a second front side and a second back side;

a fabric member attached to the first front side, the fabric member and the fabric sheet defining a pocket, the pocket adapted for holding hand towels; and a first fastener and a second fastener, the first fastener attached to the first back side, the second fastener attached to the second back side, the first fastener fastening to the second fastener when the fabric sheet is folded along its transverse axis.

6. The fabric towel holder of claim 5, wherein the fabric sheet comprises a hand towel.

7. The fabric towel holder of claim 5, wherein the fabric member comprises a washcloth, the washcloth folded parallel to one of its ends, the folded end positioned adjacent the first front side, the folded washcloth comprising three unfolded ends, the unfolded ends securely attached to the fabric sheet to define the pocket.

8. The fabric towel holder of claim 5, wherein the fasteners comprise hook and loop fasteners.

9. The fabric towel holder of claim 5, wherein the fasteners comprise snaps.

* * * * *